US005081802A

United States Patent [19]

Westhoff et al.

[11] Patent Number: 5,081,802

[45] Date of Patent: Jan. 21, 1992

[54] METHOD AND APPARATUS FOR LINING MANHOLE ASSEMBLIES AND THE LIKE

[75] Inventors: James A. Westhoff, Langhorne; James A. Kelly, Warrington, both of Pa.; James E. Parker, Myakka City, Fla.

[73] Assignee: Poly-Tec Products, Inc., Tullytown, Pa.

[21] Appl. No.: 480,285

[22] Filed: Feb. 15, 1990

[51] Int. Cl.[5] ..... E02D 29/14

[52] U.S. Cl. ..... 52/20; 404/26

[58] Field of Search ..... 52/19, 20, 21; 404/25, 404/26

[56] References Cited

U.S. PATENT DOCUMENTS

| | | | |
|---|---|---|---|
| 2,028,968 | 1/1936 | Carlstrom | 52/20 X |
| 2,816,323 | 12/1957 | Munger | 52/309.17 X |
| 4,023,590 | 5/1977 | Harris et al. | 52/21 X |
| 4,089,139 | 5/1978 | Moffa et al. | 52/20 |
| 4,472,911 | 9/1984 | Jooris et al. | 52/20 |
| 4,521,941 | 11/1986 | Ditcher et al. | 404/26 |
| 4,746,127 | 5/1988 | Westhoff et al. | 52/20 X |
| 4,751,799 | 6/1988 | Ditcher et al. | 52/21 |

FOREIGN PATENT DOCUMENTS

| | | |
|---|---|---|
| 2441470 | 3/1976 | Fed. Rep. of Germany . |
| 2558469 | 7/1977 | Fed. Rep. of Germany . |

*Primary Examiner*—David A. Scherbel
*Assistant Examiner*—Linda J. Watson
*Attorney, Agent, or Firm*—Louis Weinstein

[57] ABSTRACT

Cast members are provided with a liner assembly to protect the cast material from corrosion. The liner assembly is formed of a plurality of curved liner sections having integral joining flanges. A resilient compressible gasket is arranged between opposing flanges and is provided with at least one flange receiving slot for receiving the flange of one of said liner sections to facilitate assembly thereof. Fastening means join the opposing flanges to compress the gasket and thereby provide a liquid-tight joint. Integral flanges are provided at the upper and lower ends of the liner sections to receive a sealant which is squeezed out of the seams formed by the mating sections when joined to protect the cast assembly from corrosion. The liner sections are formed of a material which is inert to the corrosive influences.

20 Claims, 5 Drawing Sheets

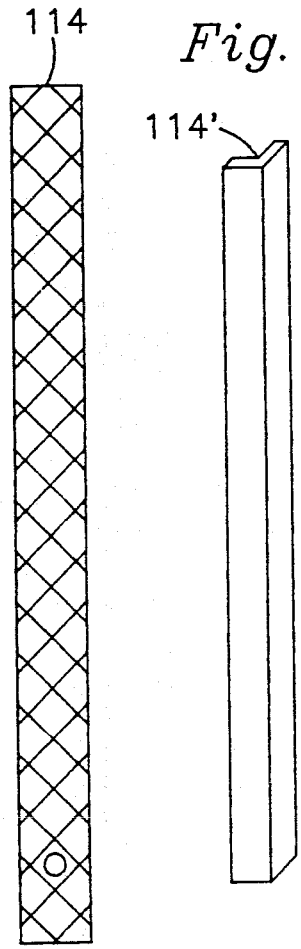
Fig. 2f
Fig. 2d
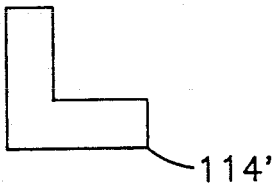
Fig. 2g
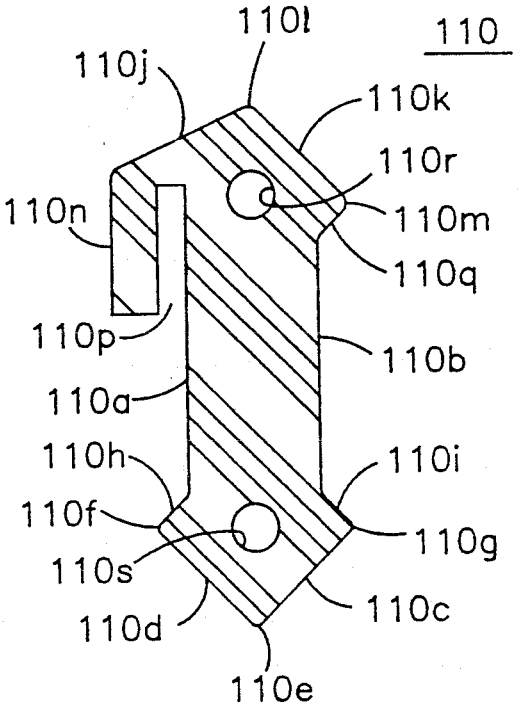
Fig. 2e
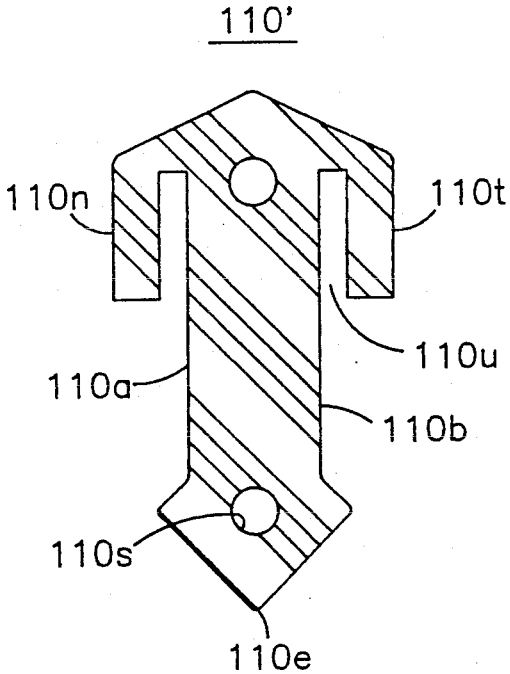
Fig. 2c

METHOD AND APPARATUS FOR LINING MANHOLE ASSEMBLIES AND THE LIKE

FIELD OF THE INVENTION

The present invention relates to manholes and more particularly, to novel liner sections and cooperating novel gasket means and assembly means for rendering the liner section waterproof to protect manhole assemblies against corrosion.

BACKGROUND OF THE INVENTION

Manhole assemblies have been found to typically experience significant interior corrosion and deterioration even in cases where high acidic effluents that are known to be harmful to sewers and sewer treatment are prohibited from entering the sewers before first being dissipated or neutralized. Nevertheless, hydrogen sulfide which is inherent in sewage, is developed due to the presence of sulfur compounds, such as sulfate, sulfite, or other inorganic or organic sulfur. The above-mentioned group of compounds are reduced to sulfide by sulfate-reducing bacteria normally found in the effluent. The generation of hydrogen sulfide is accelerated in the presence of high temperature and low flow rates. The useful life of concrete is determined by dividing the available effective thickness of the concrete by the corrosion rate. The corrosion rate can be calculated when all factors are known. The effective thickness of the concrete is the amount covering the steel reinforcement typically embedded within the manhole assembly.

Coatings have been applied to manhole interiors but have been found to have a poor track record. For example, although coal, tar, or epoxy provides effective protection against hydrogen sulfide, such coatings have provided poor field performance due to application difficulties.

As a result, linings of plastic material, such as polyvinyl chloride (PVC), provide the best performance for interior corrosion protection against hydrogen sulfide. Such plastic linings are further compatible with plastic pipe now being used extensively in sanitary systems. To date, however, it is extremely difficult to fabricate interior linings and integrate such interior linings into vertical structures and particularly manhole assemblies. Flexible type linings are presently used in pipes covering the upper 270° of the pipe interior. This portion is attacked by the $H_2S$ generated from sewage. This flexible material is not easily used on manholes which require 360° protection for the manhole interior.

U.S. Pat. No. 4,751,799, issued June 21, 1988 and assigned to the assignee of the present invention, discloses liners formed of a rigid or semi-rigid material, which liners are fabricated in sections. For example, the liners are fabricated as four separate quadrants. Each quadrant comprises a curved molded member which may, for example, be thermo-formed. Each molded member is provided with a plurality of projections each having a ducktail cross-section for securing the liner into the concrete structure. The liner sections are joined together and caulked along their engaging edges. The projections of ducktail cross-section extend outwardly from the convex surfaces of the mold members which are arranged with an interior mold assembly and are either joined against the surface of an interior mold member by standard plastic banding or are alternatively joined together end-to-end by individual holding members. These assemblies have been found to lack suitable structural strength and present additional problems in their handling and assembly. In addition, the caulking material has been found to provide unsatisfactory waterproof seams within the manhole assembly structure.

BRIEF DESCRIPTION OF THE INVENTION

The present invention is characterized by comprising a novel manhole liner assembly which includes curved liner sections which are assembled together to form an interior liner assembly.

The interior liner assembly for the present invention is utilized for precast concrete wastewater structures which combines the immense structural strength and integrity of reinforced concrete with the chemical resistant advantages of the liners, which are preferably formed of polyvinyl chloride (PVC).

The liner is preferably thermo-formed from a semi-rigid thermoplastic sheet to the required contour of the manhole structure. A ribbed design is utilized to integrally cast the liner to the concrete wall during the manufacture of the precast component. Elimination of ducktail-shaped projections, in addition to eliminating unnecessary manufacturing steps also provides a permanent mechanical bond to the concrete and, once the concrete components are assembled on the job site, provides a continuous and impermeable lining for shielding the concrete against deterioration by corrosive matter. The liner also allows pipe entry openings to be lined and sealed to further safeguard against corrosion.

Each of the liner sections are joined about their sides by means of a novel rubber gasket comprising an elongated strip having a predetermined cross-section and provided with an integral flange to permit the gasket to be "clipped on" to a flange of one of the molded liner sections to automatically position the gasket preparatory to assembly for greatly simplifying the assembly operation.

As an alternative embodiment, the gasket may be provided with a pair of such flanges for coupling adjacent liner sections to still further simplify the assembly.

The flanges are then mechanically joined together either by self-tapping screws or staples. An elongated strip of expanded metal or plastic preferably in an angle shape (i.e. L-shaped cross-section) may be utilized to provide sufficient torque for insertion and securement of the fastening means.

The apparatus of the present invention provides distinct advantages over traditional coatings and other protective measures presently available for protecting concrete from corrosion and sanitary sewer structures. The basic properties of PVC in regard to being chemically inert and having a superior strength to weight ratio, creates a tough, corrosion resistant surface giving the concrete structure surface life compatible with PVC and PVC-lined pipe. The assembly of the present invention provides a long service life even under severe conditions, providing resistance to $H_2S$, acids, alkalis, and salts which attack sewer systems.

In addition thereto, the liner sections are a smooth white which is highly light reflective and environmentally pleasing and further prevent fungus or bacteria from permanently clinging to the liner allowing the walls to be easily cleaned and maintained.

The novel resilient gasket provides an excellent watertight seal between adjacent sections which maintains its integrity even after long continuous use and which further serves to greatly facilitate assembly of the liner sections preparatory to casting. The gasket flanges serving as "clips" also serve to enhance the securement of the liner assembly to the manhole member being cast integral with said liner assembly.

Manhole assemblies including the manhole base, riser and top sections may be fabricated utilizing the liner sections described hereinabove.

The liner assembly forms an integral part of each cast member. The manhole sections are assembled one upon the other. The liner sections are each provided with flanges at each of the mating surfaces of the adjoining manhole sections. Suitable sealing means is provided for assuring the provision of an excellent liquid-tight seal. The liner protects the manhole assembly from corrosion and is retained in place within the cast members due to the gaskets and ribs, assuring a rugged, serviceable liner for protecting the concrete manhole sections against corrosion.

OBJECTS OF THE INVENTION AND BRIEF DESCRIPTION OF THE FIGURES

It is, therefore, one object of the present invention to provide precast concrete vertical place structures or manhole assemblies having novel liner assemblies impervious to toxic materials for protecting the concrete.

Still another object of the present invention is to provide a novel liner assembly for lining and protecting annular concrete structures and the like from corrosion, said liner assembly being formed of liner sections having integral flanges joined to one another by suitable fastening means, resilient gasket means being provided between the joined flanges and further including at least one flange serving as a means for clipping the gasket to one of said liner section flanges preparatory to assembly to facilitate the assembly operation.

Still another object of the present invention is to provide novel liner sections and gasket means, the liner sections being joined to one another with the gasket means arranged therebetween and including novel fastening means for assuring adequate securement of liner sections to one another and providing a good liquid-tight seal between the joined sections.

The above, as well as other objects of the present invention will become apparent when reading the accompanying description and drawings, in which.

Figure 2:
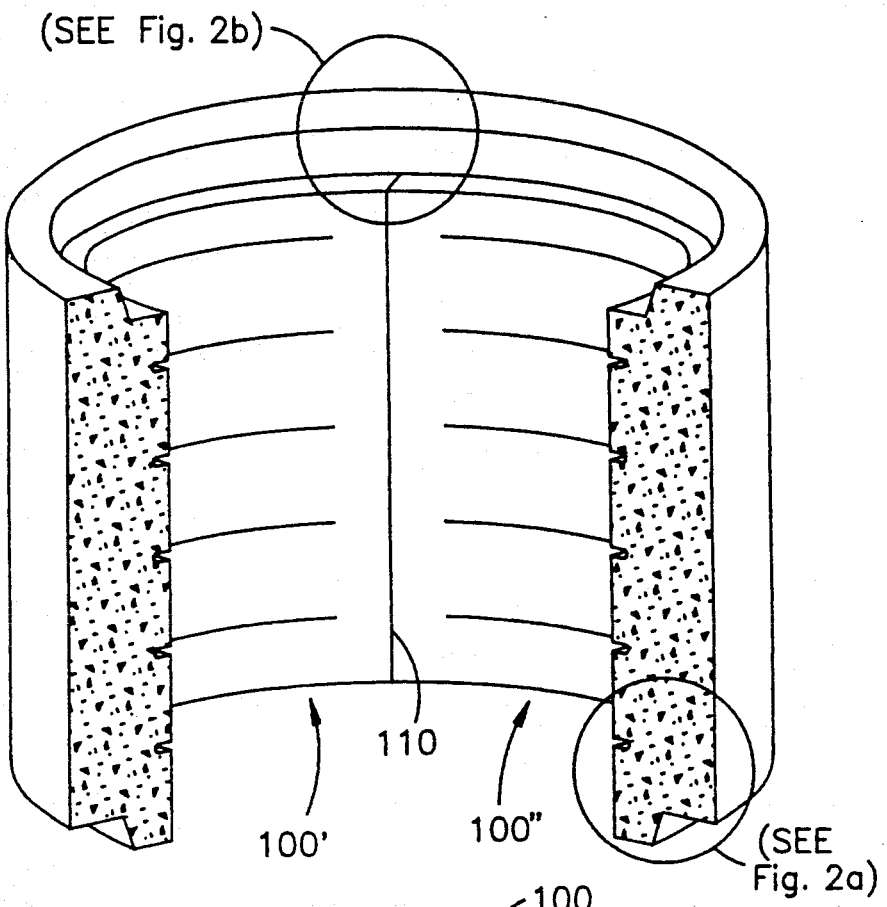
FIG. 2 shows a perspective view of manhole section containing the liner sections of the present invention and cast into the section.
Figure 2A:
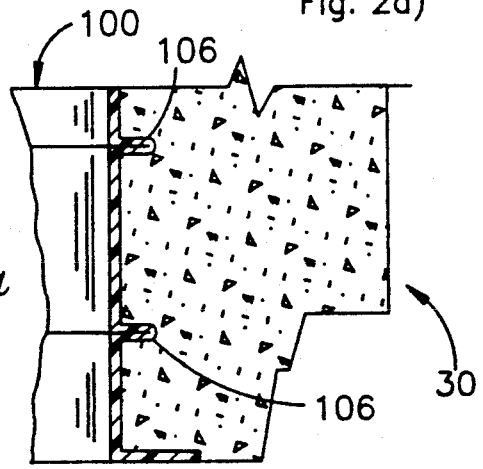
Figure 2B:
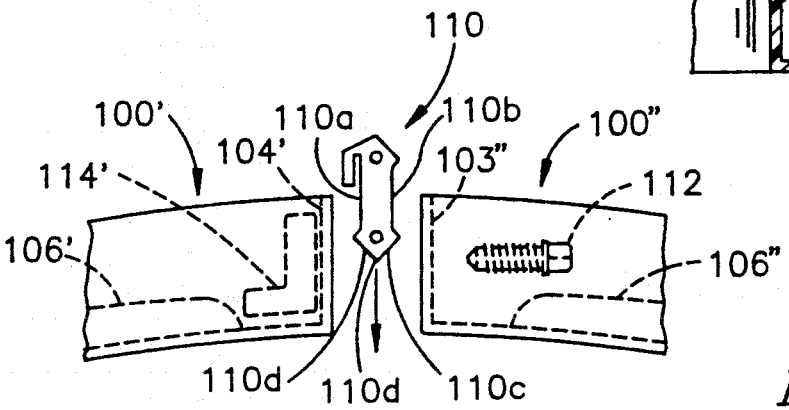
Figure 3A:
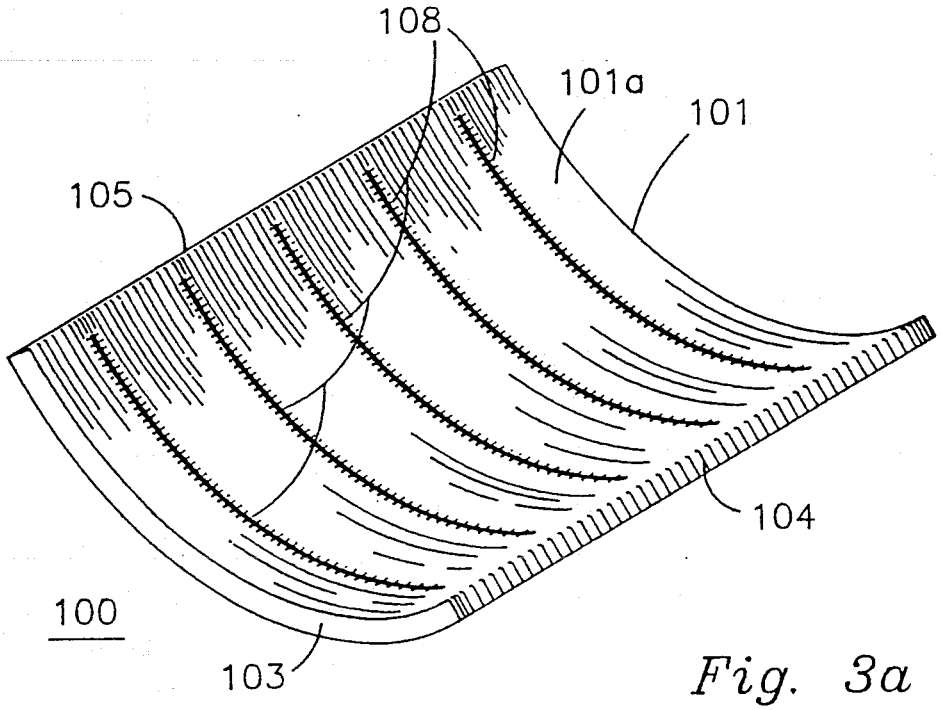
Figure 3B:
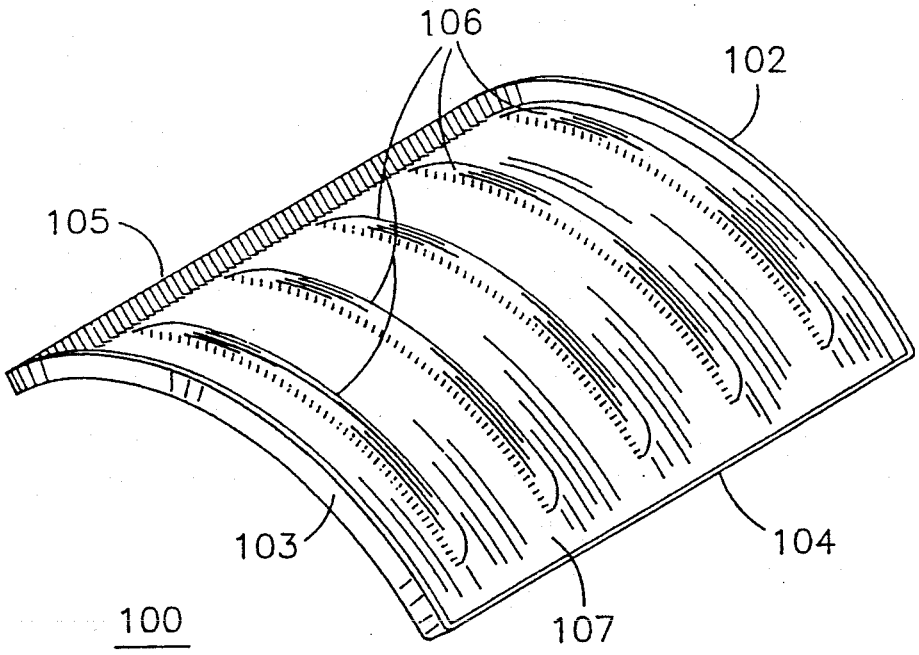
Figure 4A:
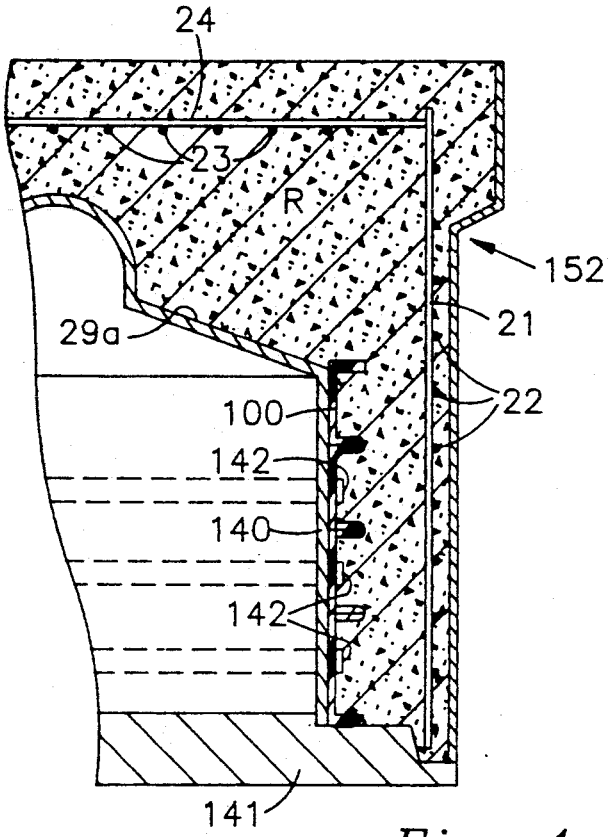
Figure 4C:
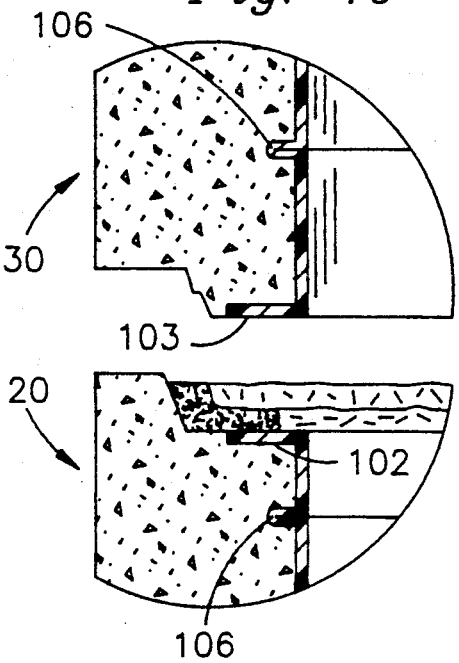
Figure 4B:
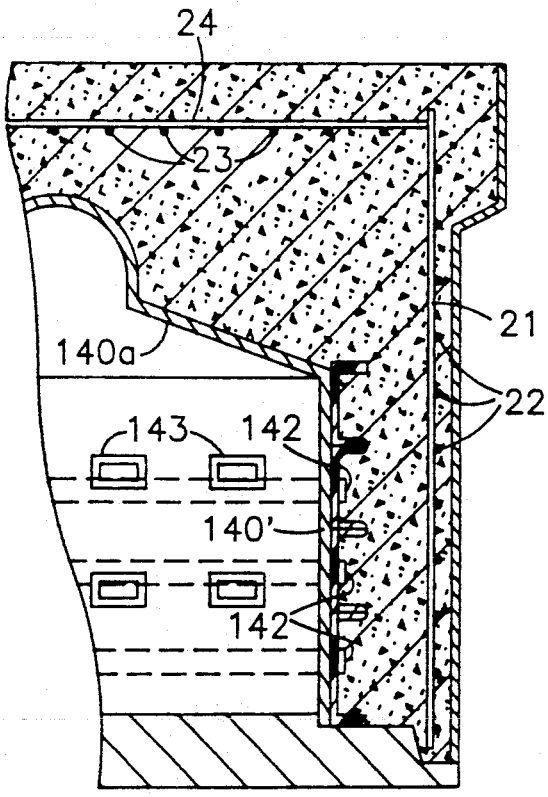
Figure 4D:
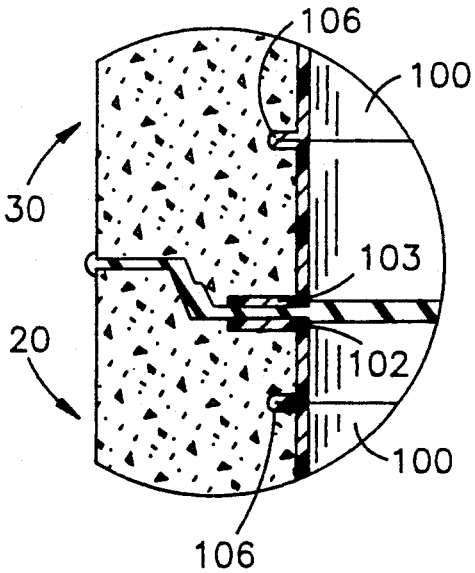

FIG. 2*a* shows a sectional view of a portion of the manhole assembly of FIG. 2;

FIG. 2*b* shows an exploded top view of a typical rubber joint of the manhole assembly shown in FIG. 2;

FIG. 2*c* shows a view of a cross-section of another preferred embodiment for the rubber gasket;

FIG. 2*d* shows a strip of expanded metal for use in the fastening assembly of FIG. 2*b*, for example;

FIG. 2*e* shows an enlarged cross-section of the gasket of FIG. 2*b*;

FIG. 2*f* is a perspective view of another strip which may be substituted for the strip shown in FIG. 2*e*;

FIG. 2*g* is an end view of the strip of FIG. 2*f*;

FIGS. 3*a* and 3*b* show perspective front and rear views of a typical liner section;

FIGS. 4*a* and 4*b* show sectional views of an assembly for casting a manhole section employing the liner assembly of the present invention; and FIGS. 4*c* and 4*d* show sectional views of adjacent manhole sections which views are useful in explaining the liquid-tight joint formed between sections.

DETAILED DESCRIPTION OF THE INVENTION

Figure 1:
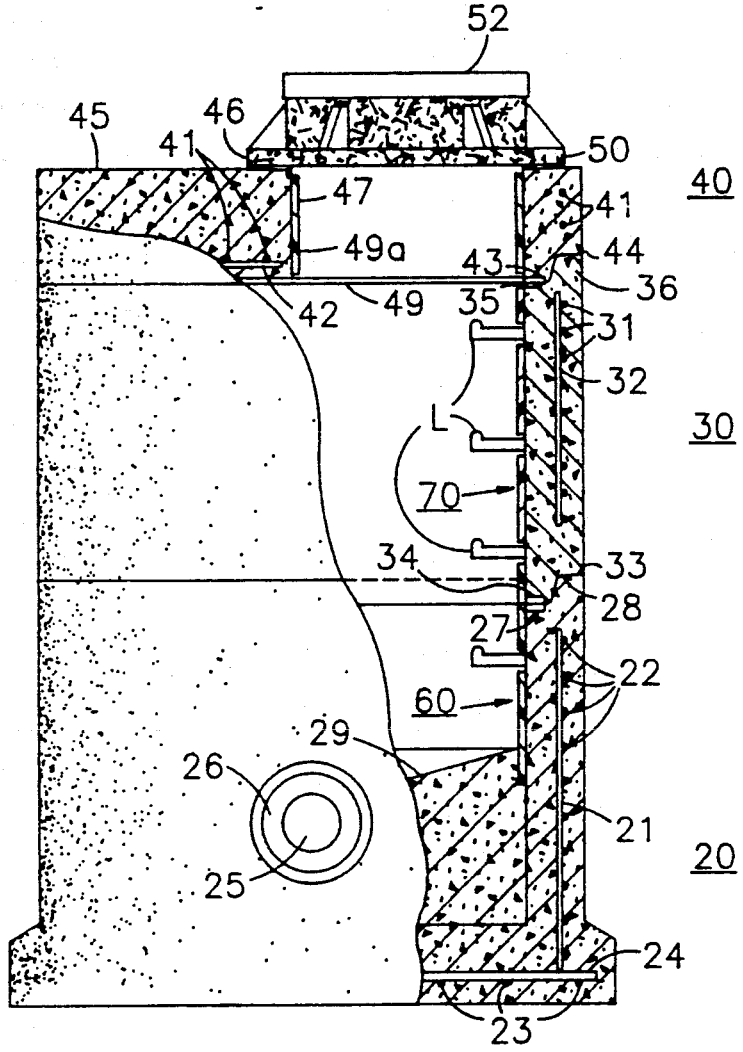
FIG. 1 shows a sectional view of a manhole assembly embodying the principles of the present invention.

FIG. 1 shows a manhole assembly 10 comprised of manhole base 20, riser section 30 and top section 40. The base, riser and top sections each have a cylindrical shape although the top section 40 is shorter than sections 20 and 30 and provides a top opening for receiving the cast iron frame and sewer lid cover shown respectively at 50 and 52 in FIG. 1.

Base member 20 is formed of concrete and has a steel reinforcing framework comprised of a gridwork of vertically (straight) and horizontally (annular) aligned rods 21 and 22, respectively. A similar grid framework of perpendicularly arranged (straight) rods 23 and 24 are provided in the floor of base member 20, as is conventional.

Base member 20 is provided with at least first and second openings, one of which is shown at 25, each such opening being adapted to receive one end of a pipe section. A resilient rubber-like seal 26 is arranged within opening 25 and is preferably cast therein, but can be hydraulically placed after the opening is either cast or cored to provide a watertight seal between the pipe section (not shown) and the manhole opening 26.

The top edge of base member 20 is provided with an interior shoulder 27 having an outer projection 28 surrounding shoulder 27.

Cylindrical-shaped riser section 30 has a similar reinforcement structure comprised of horizontally aligned (straight) and vertically (annular) steel rods 31 and 32. The bottom edge of the riser section has an outer shoulder 33 which rests upon the top surface of projection 28 and has an interior projection 34 surrounded by shoulder 33 and resting upon shoulder 27, as shown. The top end of riser section 30 is provided with an inner shoulder 35 and a surrounding outer projection 36 similar to the shoulder 27 and projection 28 of base member 20. Top section 40 is reinforced by horizontally aligned (annular) reinforcement rods 41 and a reinforced steel plate 42, when required. Top section 40 has a bottom edge having an outer shoulder 44 resting upon projection 36 and an inner projection 43 resting upon shoulder 35. The cast iron cover support frame 50 rests upon the top surface 45 of top section 40 and is aligned with opening 46. A water lock entry sleeve 47 may be provided within opening 46. A cylindrical-shaped protective liner 49 has a portion 49*a* extending into a lower portion of opening 46 to provide corrosion protection.

The sections 20 and 30 are provided with corrosion protecting liner assemblies 60 and 70 each of which lines the entire interior surface of the associated manhole section and thereby protects the surface from corrosion. Each liner assembly is provided with outwardly directed horizontally aligned flanges 102, 103 at the upper and lower ends thereof (FIGS. 2, 2*a*, 3*a*, 3*b*), which flanges engage flanges of the adjacent liner assembly (FIGS. 4*a*, 4*b*) in a manner to be described in greater detail hereinbelow. A suitable sealant is provided between the adjacent flanges described hereinabove to assure a watertight corrosion resistant seal in the region of mating flanges. FIGS. 4*a* and 4*b* show the manner in which the caulking material, to be more fully described hereinafter, is squeezed out throughout the mating surfaces to provide the desired watertight seal.

FIGS. 3*a* and 3*b* show a typical liner section 100 in greater detail. The liner assembly provided within each manhole section is formed in sections as shown in FIGS. 3*a* and 3*b*. In one preferred embodiment, the liner assembly, is formed in four separate 90° quadrants. This 90° quadrant section may be changed relative to the manhole diameter for ease in the fabricating, handling and shipping. Also, a greater or lesser number of sections may be provided while maintaining the advantageous features of the present invention.

Quadrant 100 has a curved major portion 101 with integral flanges 102 and 103 provided respectively at the top and bottom ends thereof. In addition thereto, integral flanges 104 and 105 are arranged along the sides thereof. The ends of the flanges 104 and 105 are joined to the ends of flanges 103 and 102 with the vertices preferably being somewhat rounded. Flanges 104 and 105 are designed to receive a gasket therebetween as will be more fully described. Flanges 102 and 103 are designed to receive the caulking material arranged between these flanges and the adjacent flanges of the upper (or lower) liner section (FIGS. 4*a*, 4*b*).

The liner section is further provided with a plurality of integral curved ribs 106 arranged in spaced substantially parallel fashion and extending outwardly from the convex surface 107 of the liner section. The concave surface 101*a* is provided with slight recesses which are formed as a result of the formation of the ribs 106, said ribs and recesses, as well as the curved portion and flanges of each liner section preferably being formed in a thermo-forming operation, although a molding or extrusion operation may be employed, if desired.

The four liner sections, in the case of the preferred embodiment of the present invention, are joined together preparatory to casting a manhole section. For example, FIG. 2*b* shows the right-hand end of a liner section 100' and the left-hand end of a liner section 100'' arranged preparatory to being assembled to one another. Liner section 100' is arranged so that from the flange 103'' of the liner section 100''.

An elongated continuous gasket 110 (see also FIG. 2*e*) extending at least the height of the liner sections 100', 100'' is initially mounted upon flange 104'.

The elongated gasket 110 has a cross-section, as shown in FIG. 2*e*. The gasket is preferably formed of a rubber or rubber-like material such as EPDM.

The gasket has two substantially parallel major surfaces 110*a*, 110*b*. One side of gasket 110 has a tapered portion defined by tapered surfaces 110*c* and 110*d* which merge at a tip 110*e* at the free end thereof. The surfaces 110*c* and 110*d* taper away from tip 110*e* and each terminate in a vertex 110*f*, 110*g* the sidewalls 110*h*, 110*i* tapering rearwardly from vertices 110*f*, 110*g* to merge with surfaces 110*a*, 110*b*. The opposite end of the gasket cross-section is similar to that of the first described end and has tapered surfaces 110*j*, 110*k* which merge to form tip 1101. Surface 110*k* extends rearwardly to vertex 110*m*. Surface 110*j* extends outwardly and merges with flange 110*n* which extends parallel to surface 110*a*, forming slot 110*p*. Vertex 110*m* tapers along sidewall 110*q* and merges with surface 110*b*. The gasket is mounted to liner section 100' by insertion of flange 104' into slot 110*p* thus freeing the operator to bring liner section 100'' against the opposing surface of gasket 110. When the liner sections are brought together in this manner, suitable fastening means such as, for example, self-tapping screw 112 is inserted through flange 103'' through gasket 110 and through flange 104'. A suitable number of fasteners are arranged at spaced intervals along the liquid-tight joint formed by flanges 104', 103'', gasket 110 and fasteners 112. Openings 110*r*, 110*s* permit the gasket to yield more so in the regions of these openings to allow the tapered portions 110*f*, 110*g* and 110*m* to compress when pressed between the flanges to provide a watertight seal along the entire sides of the gasket and not merely the tapered portions.

In order to provide suitable fastening torque for the self-tapping screws, an elongated metallic strip 114, or plastic angle shape 114', is positioned against the left-hand surface of flange 104' as shown in FIG. 2*c*. FIG. 2*f* shows a plan view of the expanded metal strip or plastic angle shape 114 which, due to its unique structure is easily tapped by the self-tapping screw 112. A plurality of self-tapping screws arranged at spaced intervals along the flanges intimately secure the flanges to one another. The tightening of the self-tapping screws cause the rubber gasket to be compressed, and especially the vertices 100*m*, 100*f* and 100*g*, the compression being sufficient to provide an excellent watertight seal between the joined flanges.

Although not shown herein for purposes of simplicity, all four quadrants of the liner sections are joined in a similar fashion, resulting in an annular-shaped assembled liner structure.

The fully assembled liner structure is arranged within a conventional mold assembly of the type shown, for example, in FIGS. 4*a* and 4*b*. The molding technique shows the manner of casting a manhole base in an "upside-down" fashion and employing an inner mold member 140 and an outer mold member 150 resting on the base mold member 141. Only a portion of the mold assembly has been shown herein for purposes of simplicity.

The fully assembled liner structure is arranged against the convex surface of the inner mold 140 as shown, for example, by liner section 100. Inner mold portion 140*a* defines the invert provided within the cast manhole base.

The liner sections are retained against the inner mold member 140 by the fastening assembly shown, for example, in FIG. 2*b* and having the gaskets 110 compressed between the flanges joined by each fastening assembly.

A steel reinforcing framework made up of steel rods 21, 22, 23 and 24 are arranged in grid-like fashion (note also FIG. 1) and are inserted within the mold. Thereafter, the cast material, preferably concrete, is poured into the hollow region R of the mold assembly and is allowed to set.

Once the cast material is set, the entire assembly is inverted, whereupon the cast member is now "right-side-up". The mold members are then lifted away from the cast member. FIG. 2 shows a sectional view of a cast riser section 30 shown also in FIG. 1.

The ribs 106 as shown in FIGS. 2*a* and 3*b* are embedded in the concrete and serve to add structural strength to the resulting cast member, the ribs and concrete cooperating with one another to enhance the structural strength of the resulting manhole section. The base, riser and top sections are all formed in a substantially similar manner using appropriate mold assemblies. The riser and top sections can be cast in either the right-side up or upside-down fashion.

The manhole sections which receive ladder members receive a plastic insert 143 prior to casting and thereby form openings within the cast member for receiving the free ends of the substantially U-shaped ladder members L shown in FIG. 1. These plastic inserts are described in detail in U.S. Pat. No. 3,974,615 assigned to A-LOK Products, Inc. After the cast member is set and removed from the mold assembly, the ladder members L (FIG. 1) are pressed into the aforementioned inserts to form a press-fit therewith.

The invert surface 29 within base member 20 (see FIG. 4) is preferably coated with an epoxy having silica added to provide a non-skid surface which is substantially corrosion resistant.

The liner sections which are aligned with openings in the cast member, such as opening 25 (FIG. 1) are also provided with openings aligned with the openings in the cast member to receive the conduits (not shown) to be inserted into the cast member openings.

The casting technique described hereinabove is typically referred to as a single-pour technique in that the inverted non-skid surface 29*a* is formed at the same time as the base member. It should be understood, however, that the liner assembly of the present invention may be utilized in the two-pour technique in which the invert portion of a manhole base is formed in situ (i.e. at the final installation site). The two-pour technique is described, for example, in U.S. Pat. No. 4,751,799, assigned to A-LOK Products, Inc. and will not be described herein in detail, said patent being incorporated herein by reference thereto.

After all the manhole members have been cast, and when they are assembled one upon the other, the engaging surfaces thereof, including the engaging surfaces of the liner flanges are coated with a suitable caulking material 111 as shown, for example, in FIGS. 4*c* and 4*d*. A generous amount of the caulking material, which may, for example, be a suitable butyl rubber, is preferably applied to section 20 (see FIG. 4*c*) so that when the sections 20 and 30 are properly stacked one upon the other as shown in FIG. 4*d*, the caulking material is squeezed out of the interior and exterior portions of the joint thereby assuring that no concrete will be exposed to corrosive materials.

The liner is preferably formed of a plastic material highly resistant to acids and especially hydrogen sulfide and sulfuric acid. The sheet material may, for example, be fiberglass or any suitable thermoplastic such as PVC.

FIG. 2*c* shows an alternative arrangement for the gasket 110. The gasket 110' shown in FIG. 2*c* is substantially the same as the gasket 110 shown in FIG. 2*b* with the exception of an additional flange 110*t* positioned adjacent surface 110*b* so as to form a slot 110*u* which is adapted to receive a flange of the liner section adjacent surface 110*b*. For example, considering FIG. 2*b*, flange 104' is inserted into slot 110*p* whereas flange 103'' is inserted into slot 110*u*.

These flanges are then fastened together by the fastening assembly shown in FIG. 2*b*, for example, employing self-tapping screws 112 and metal backing strip 114, or plastic angle shape 114' (see FIGS. 2*d* and 2*f*–2*g*), the fasteners being secured to adequately compress the gasket between the flanges 104' and 103'' sufficient to form an adequate and reliable watertight seal therebetween.

As an alternative to the use of the self-tapping screws 112, industrial-type staples may be employed. The staples may be inserted into the flanges to be joined by means of an industrial stapling gun for shooting staples into the structure. The self-tapping screws and staples may be utilized either with or without the metal strip 114, or plastic angle shape 114' (see FIG. 2*b*). However, the metal strip and plastic angle shape 114 (or 114') is found to provide the necessary torque for the self-tapping screws as well as providing additional supporting strength for flange 104' in support of the bent-over arms of the staple, said staples being generally of a U-shaped configuration with the yoke portion, for example, of the staple being in engagement with the flange 103'' and with the arms thereof penetrating through flange 103'', gasket 110 and flange 104'' and the metal backing strip 114, or plastic angle shape 114', when it is employed.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A liner assembly for lining the annular-shaped interior of a cast structure to protect the cast structure from corrosion, said assembly comprising:

a plurality of liner sections, each section being comprised of a curved semi-rigid member having a convex surface engaging said cast structure and a concave surface defining the interior of said structure;

said member having a plurality of spaced substantially parallel ribs integral with said member and extending into and embedded in said cast structure;

the opposing sides of each member extending substantially parallel to the longitudinal axis of said annular-shaped interior having integral flanges extending outwardly from said convex surface and into said cast member;

the flanges of each member being arranged in opposing fashion with the flanges of adjacent members forming said liner assembly;

resilient, compressible gasket means being arranged between the flanges of adjacent members;

fastening means joining the opposing flanges for compressing said gasket therebetween to form a liquid-tight seal along said joint;

said gasket being an elongated strip of resilient compressible material having a substantially oblong cross-section, said strips extending the entire length of each joint defined by the opposing flanges of adjacent liner section members;

said liner assembly providing a liquid-tight seal about the annular interior of said cast member.

2. The apparatus of claim 1 wherein said gasket is provided with a pair of substantially parallel opposing surfaces each aligned with an associated one of the flanges being joined;

said gasket having projections extending from said surfaces toward an associated flange and being initially compressed when the flanges being joined are brought together.

3. The apparatus of claim 1 wherein said gasket is provided with an integral flange extending the length of said gasket and forming a receiving slot with one of the sides of said gasket said slot adapted for receipt and engagement of a flange;

said receiving slot receiving one of said flanges for aligning said gasket to said flange preparatory to joining adjacent opposing flanges.

4. The apparatus of claim 1 wherein said fastening means comprises self-tapping screws.

5. The apparatus of claim 1 wherein said fastening means comprises staples.

6. The apparatus of claim 1 further comprising an elongated member arranged along the surface of one of said flanges for receiving said fastening means and providing additional reinforcement for each joint.

7. The apparatus of claim 6 wherein said elongated member is a metallic strip formed of an expanded metal.

8. The apparatus of claim 6 wherein said elongated member is a plastic strip.

9. The apparatus of claim 8 wherein said plastic strip has a substantially L-shaped cross-section.

10. The apparatus of claim 1 wherein said gasket is further provided with first and second flanges each extending the entire length of said gasket;

each flange forming a receiving slot with an associated side of said gasket;

each receiving slot adapted to receive one of the flanges forming a joint for maintaining the flanges and gasket in position preparatory to receiving said fastening means.

11. The apparatus of claim 1 wherein said gasket is formed of a suitable rubber or rubber-like material.

12. The apparatus of claim 11 wherein said material is EPDM.

13. The apparatus of claim 1 wherein each of said curved members is provided with integral flanges extending along the curved sides of each member and being substantially perpendicular to the longitudinal axis of said annular-shaped interior region;

said flanges extending outwardly from the convex surface of each curved member and extending into said cast member.

14. The apparatus of claim 13 wherein said gasket is further provided with first and second flanges each extending the entire length of said gasket;

each flange forming a receiving slot with an associated side of said gasket;

each receiving slot adapted to receive one of the flanges forming a joint for maintaining the flanges and gasket in position preparatory to receiving said fastening means.

15. The apparatus of claim 1 wherein said cast member is formed of concrete.

16. The apparatus of claim 1 wherein said liner assembly is comprised of at least two liner sections of substantially equal size.

17. The apparatus of claim 1 wherein said liner assembly is comprised of four liner sections of substantially equal size.

18. The apparatus of claim 1 wherein said plastic material is taken from the group consisting of fiberglass, polyvinyl chloride (PVC), ABS, polyethylene and polypropylene.

19. A method for producing manhole sections provided with a corrosion-resistant liner assembly, comprising the steps of:

(a) providing a plurality of curved liner sections each having a concave surface which when said liner sections are joined, define the interior surface of an annular assembly for lining said manhole section;

(b) providing vertically aligned integral flanges along each side of each liner section;

(c) arranging the flanges of adjacent liner sections in closely spaced opposing fashion;

(d) providing a gasket comprised of an elongated strip having an elongated continuous integral flange joined adjacent one end of said strip and cooperating with said strip to form a flange receiving slot;

(e) mounting said gasket upon one of said flanges by inserting said one of said flanges into said flange receiving slot;

(f) positioning the opposing flange of an adjacent liner section into engagement with the side of said gasket means strip opposite said flange receiving slot;

(g) utilizing fastening means for joining said flanges engaging said gasket means for securing said adjacent liner sections to one another and compressing said gasket means an amount sufficient to create a corrosion-resistant liquid-tight seal in said joint;

(h) assembling all of said liner sections to one another utilizing steps (c) through (g);

(i) casting a manhole section about said assembled liner sections to form a manhole section of generally cylindrical shape having an interior substantially cylindrical-shaped surface engaging the convex surfaces of said assembled liner sections;

(j) said flanges forming said joints extending into said cast material and being embedded therein.

20. A method for producing manhole sections provided with a corrosion-resistant liner assembly, comprising the steps of:

(a) providing a plurality of curved liner sections each having a concave surface which when said liner sections are joined, define the interior surface of an annular assembly for lining said manhole section;

(b) providing vertically aligned integral flanges along each side of each liner section;

(c) arranging the flanges of adjacent liner sections in closely spaced opposing fashion;

(d) providing a gasket comprised of an elongated strip having a pair of elongated continuous integral flanges each joined adjacent one end of said strip and cooperating with opposing sides of said strip to form flange receiving slots;

(e) mounting said gasket upon one of said flanges by inserting said one of said flanges into adjacent flange receiving slot;

(f) positioning the opposing flange of an adjacent liner section into engagement with the side of said gasket means strip opposite said flange receiving slot and inserting said flange into the remaining flange receiving slot;

(g) utilizing fastening means for joining said flanges engaging said gasket means for securing said adjacent liner sections to one another and compressing said gasket means an amount sufficient to create a corrosion-resistant liquid-tight seal in said joint;

(h) assembling all of said liner sections to one another utilizing steps (c) through (g);

(i) casting a manhole section about said assembled liner sections to form a manhole section of generally cylindrical shape having an interior substantially cylindrical-shaped surface engaging the convex surfaces of said assembled liner sections;

said flanges forming said joints extending into said cast material and being embedded therein.

* * * * *

UNITED STATES PATENT AND TRADEMARK OFFICE

CERTIFICATE OF CORRECTION

PATENT NO. : 5,081,802

DATED : January 21, 1992

INVENTOR(S) : Westhoff et al.

It is certified that error appears in the above-identified patent and that said Letters Patent is hereby corrected as shown below:

Column 5, line 42, after "that" insert -- its flange 104' lies a close spaced distance --

Signed and Sealed this

Sixth Day of April, 1993

*Attest:*

STEPHEN G. KUNIN

*Attesting Officer*

*Acting Commissioner of Patents and Trademarks*